US006356732B1

(12) United States Patent
Watanabe et al.

(10) Patent No.: US 6,356,732 B1
(45) Date of Patent: Mar. 12, 2002

(54) IMAGE FORMING APPARATUS WITH SELECTIVE COLOR MODE

(75) Inventors: Kenji Watanabe, Numazu; Takayuki Miyamoto, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/541,616

(22) Filed: Apr. 3, 2000

(30) Foreign Application Priority Data

Apr. 6, 1999 (JP) ..... 11-098483
Mar. 28, 2000 (JP) ..... 2000-088164

(51) Int. Cl.[7] ..... G03G 15/01
(52) U.S. Cl. ..... 399/299; 399/302
(58) Field of Search ..... 399/66, 298, 299, 399/300, 302, 303

(56) References Cited

U.S. PATENT DOCUMENTS 5,010,370 A 4/1991 Araya et al.
5,678,149 A * 10/1997 Takekoshi et al. ..... 399/299
5,732,314 A 3/1998 Tsukida et al. ..... 399/302
5,765,082 A * 6/1998 Numazu et al. ..... 399/299
5,842,095 A * 11/1998 Kitamura ..... 399/299
6,044,237 A 3/2000 Numagami et al. ..... 399/104
6,134,402 A * 10/2000 Nakayama et al. ..... 399/299 X
6,173,141 B1 * 1/2001 Sakagami et al. ..... 399/300 X

FOREIGN PATENT DOCUMENTS

JP 9-288396 11/1997

* cited by examiner

*Primary Examiner*—Sandra Brase
(74) *Attorney, Agent, or Firm*—Fitzpatrick, Cella, Harper & Scinto

(57) ABSTRACT

An image forming apparatus including a plurality of image bearing members for respectively bearing images of different colors, a transfer material bearing member for bearing a transfer material, wherein selectable is a mode for transferring, to the transfer material borne by the transfer material bearing member, an image of predetermined color from a predetermined image bearing member only, selected among the plurality of image bearing members. A deforming device for deforms the conveying surface of the transfer material bearing member for the transfer material, the deforming device being adapted, when such mode is selected, to deform the conveying surface in such a manner that the predetermined image bearing member alone comes into contact with the transfer material borne by the transfer material bearing member, wherein the deforming device is adapted to contact the transfer material bearing surface of the transfer material bearing member thereby deforming the conveying surface.

37 Claims, 7 Drawing Sheets

IMAGE FORMING APPARATUS WITH SELECTIVE COLOR MODE

BACKGROUND OF THE INVENTION

1. Field of the Invention

The present invention relates to an image forming apparatus such as a copying apparatus, a printer or a facsimile apparatus, and more particularly to an image forming apparatus in which an image on an image bearing member is transferred onto a transfer material borne on a transfer material bearing member.

2. Related Background Art

With the recent popularization of the electrophotographic color image forming apparatus, there is an increasing requirement for the higher color output, in addition to the requirement for the higher recording quality of the color image. In order to meet such requirements, there are being proposed certain image forming methods, including a tandem color image forming method in which the images are formed by BK (black) toner, C (cyan) toner, M (magenta) toner and Y (yellow) toner respectively on drum-shaped image bearing members, then are transferred in succession by respective transfer means onto a transfer material conveyed by a transfer conveying belt and are finally fixed as disclosed for example in the Japanese Patent Application Laid-Open No. 9-288396.

In such tandem color image forming apparatus, as shown in FIG. 6, transfer materials set in a cassette 50 mounted in the lower right side portion of the main body of the apparatus are taken out, one by one, by a feed roller 51 and fed by paired rollers 52, 53 to an image forming unit.

In the image forming unit, a transfer conveying belt 54 for conveying the transfer material is stretched around plural rotary rollers to be formed in a planiform shape in the conveying direction of the transfer material (from right to left in FIG. 6), and, at the most upstream position, the transfer material is electrostatically attracted to the transfer conveying belt 54 by an attraction roller 55 to which a bias voltage is applied. Opposed to the conveying surface of the belt, there are linearly provided four drum-shaped image bearing members (hereinafter called photosensitive drums) 56*a*, 56*b*, 56*c*, 56*d* constituting image forming means. On each of the photosensitive drums 56*a*, 56*b*, 56*c*, 56*d* a charger and a developing device are provided along the periphery of the photosensitive drum, and a transfer member is disposed with interposing the conveying surface of the transfer conveying belt 54 between the photosensitive drum and the transfer member.

The casings of the above-mentioned developing devices respectively contain toner of yellow, magenta, cyan and black colors from the upstream side (right side in FIG. 6) in the conveying direction of the transfer material, and a color image is formed by transfer of the images of respective colors in succession to the transfer material conveyed by the transfer conveying belt 54. The transfer material is then conveyed to fixing means 57, positioned at the left-hand side of the apparatus, for image fixation and is discharged from the apparatus.

Such a color image forming apparatus does not necessarily always execute multi-color or full-color recording but the monochromatic recording with black color only is also executed considerably frequently. In order to accommodate such a mode of use, there is proposed a tandem color image forming apparatus capable of switching full-color recording and monochromatic recording.

For example, as shown in FIG. 7A, the transfer portions other than that for the black color are rendered retractable, together with the transfer conveying belt 54, by rotation about a support roller 58 which is positioned at the upstream side of the black photosensitive drum 56*d* and is contact with the internal surface of the transfer conveying belt 54. In case of monochromatic recording, the transfer portions other than that for the black color are retracted, together with the transfer conveying belt 54, by rotation as shown in FIG. 7B, whereby the black image alone is recorded. With such a configuration, the conveying path for the transfer material from the attraction roller 55 through the black image forming unit to the fixing means 57 remains same in the full-color recording and in the monochromatic recording, whereby stable conveying performance can be attained.

However, at the monochromatic recording with black color, the photosensitive drums other than that 56*d* for the black color are separated from the transfer conveying belt 54, so that the transfer material is conveyed without regulation over a longer distance before reaching the black toner image transfer portion. With such longer conveying distance, the charge of the transfer material supplied by the attraction roller 55 is gradually dissipated from the transfer material, whereby the electrostatic attractive force becomes weaker.

Also at the projection of the transfer conveying belt 54 formed by the supporting roller 58, the leading end of the transfer material is lifted by the rigidity thereof from the transfer conveying belt 54 and may be eventually peeled therefrom. In such a case, the transfer material may not be properly conveyed to the black image transfer portion to cause sheet jamming, or the leading position of the image on each transfer material may fluctuate because the way of the transfer material is varied by such sheet peeling whereby the image is transferred at a timing different from the originally designed timing.

SUMMARY OF THE INVENTION

An object of the present invention is to provide an image forming apparatus capable of preventing the peeling of the transfer material from the transfer material bearing member, or the aberration in the position of the transfer material borne on the transfer material bearing member.

Other objects of the present invention, and the features thereof, will become fully apparent from the following detailed description, which is to be taken in conjunction with the accompanying drawings.

DESCRIPTION OF THE PREFERRED EMBODIMENTS

In the following there will be explained an image forming apparatus constituting an embodiment of the present invention, with reference to the accompanying drawings.

Figure 1:
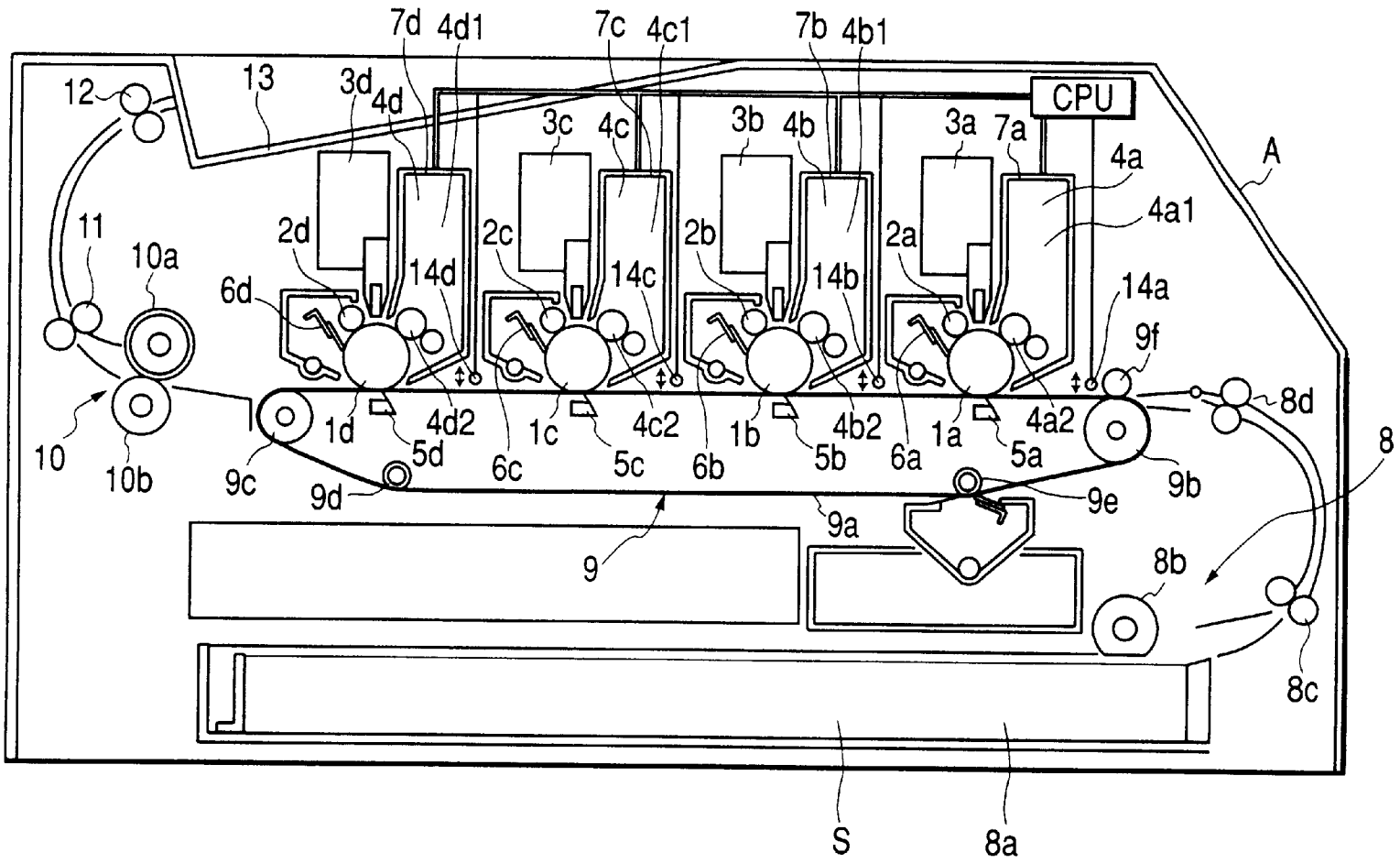
FIG. 1 is a schematic cross-sectional side view of an image forming apparatus showing a state for color recording.
Figure 3:
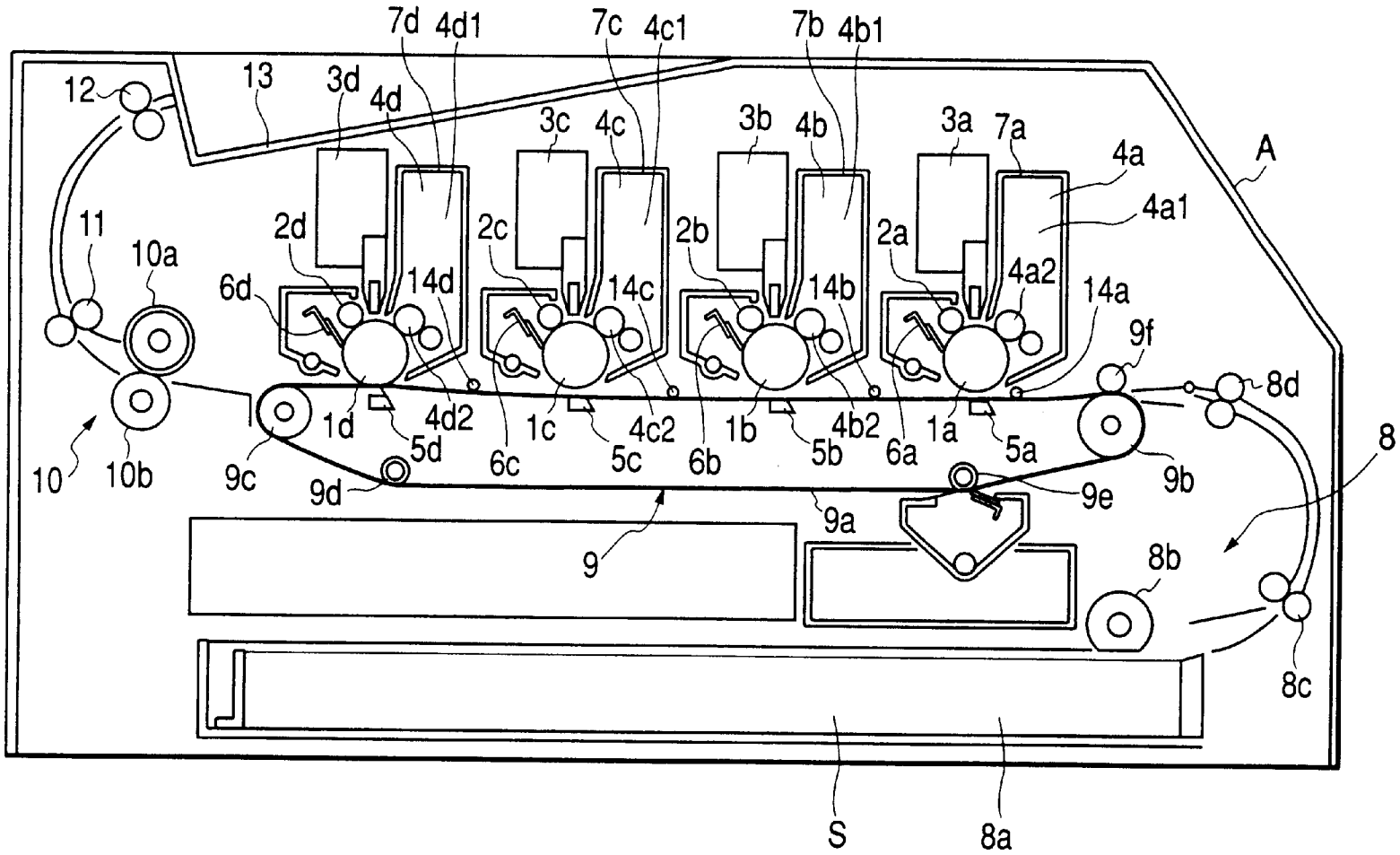
FIG. 3 is a schematic cross-sectional side view of an image forming apparatus showing a state for monochromatic recording.

FIGS. 1 and 3 are schematic cross-sectional side views of an image forming apparatus of the present invention, respectively in a state for color recording and in a state for monochromatic recording.

<Entire Configuration>

Figure 2:
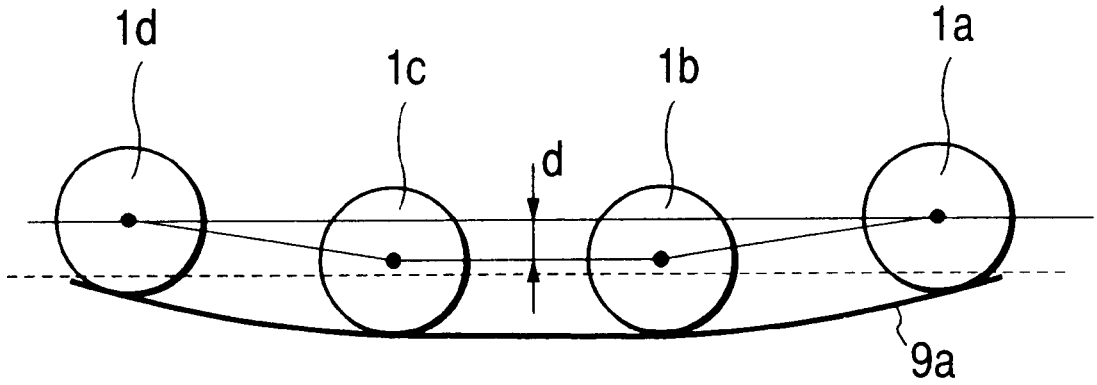
FIG. 2 is a view showing an arrangement of photosensitive drums.

The illustrated color image forming apparatus A is provided with four photosensitive drums 1 (1*a*, 1*b*, 1*c*, 1*d*) of a same shape, in which the two photosensitive drums 1*b*, 1*c* in the middle are so positioned as to protrude toward the transfer conveying belt with respect to the photosensitive drums 1*a*, 1*d* at both ends, as shown in FIG. 2, by distance d of about 1 mm. The photosensitive drums 1 are rotated clockwise by unrepresented drive means.

Around each of the photosensitive drums 1, there are provided, along the rotating direction thereof, charging means 2 (2*a*, 2*b*, 2*c*, 2*d*) for uniformly charging the surface of the photosensitive drum 1, exposure means 3 (3*a*, 3*b*, 3*c*, 3*d*) for irradiating the photosensitive drum 1 with a laser beam according to the image information thereby forming an electrostatic latent image on the photosensitive drum 1, developing means 4 (4*a*, 4*b*, 4*c*, 4*d*) for depositing toner on the electrostatic latent image thereby forming a visible toner image, transfer means (transfer blade) 5 (5*a*, 5*b*, 5*c*, 5*d*) for transferring the toner image from the photosensitive drum 1 onto the transfer material, and cleaning means 6 (6*a*, 6*b*, 6*c*, 6*d*) for removing the untransferred toner remaining on the surface of the photosensitive drum 1 after the image transfer, thereby constituting image forming means.

Each photosensitive drum 1, and corresponding charging means 2, developing means 4 and cleaning means 6 are integrally made into a process cartridge 7 (7*a*, 7*b*, 7*c*, 7*d*) which is detachably mountable to the main body of the apparatus.

A transfer material S fed from a feeding portion 8 is conveyed by conveying means 9, composed of a conveying belt, to the aforementioned image forming means, then subjected to the formation of a color image by successive transfers of the toner images of respective colors, then subjected to image fixation by fixing means 10 and finally discharged to a discharge portion 13 by paired discharge rollers 11, 12.

In the following there will be explained the configuration of various units in succession.

<Image Forming Configuration>

Each photosensitive drum 1, serving as the image bearing member, is composed of an aluminum cylinder of a diameter of 30 mm, coated on the external periphery with an organic photoconductive (OPC) layer. The photosensitive drum 1 is rotatably supported by flanges at both ends, and is rotated clockwise in the drawing by the driving force transmitted from an unrepresented motor to an end.

Each charging means 2 is composed of a conductive roller which is maintained in contact with the surface of the photosensitive drum 1 and receives a charging bias voltage from an unrepresented power source, thereby uniformly charging the surface of the photosensitive drum 1 with the negative polarity.

The exposure means 3 is composed of an LED array, which is having an unrepresented SELFOC lens (trade name) at the end and is selectively turned on and off by an unrepresented drive circuit, according to the image signal.

The developing means 4 are composed of toner containers 4*a*1, 4*b*1, 4*c*1, 4*d*1 respectively containing negatively chargeable toners of black, cyan, magenta and yellow colors, developing rollers 4*a*2, 4*b*2, 4*c*2, 4*d*2 which, being adjacent to the surfaces of the photosensitive drums, are rotatively driven by unrepresented drive units and executes image development by receiving a developing bias voltage from an unrepresented developing bias source etc. In the order from the upstream side in the conveying direction of the transfer material, the toner containers 4*a*1, 4*b*1, 4*c*1, 4*d*1 respectively contain toners of yellow, magenta, cyan and black colors.

Inside the transfer conveying belt 9*a* to be explained later, there are provided, in a parallel manner, transfer blades 5 (5*a*, 5*b*, 5*c*, 5*d*) which are in contact with the transfer conveying belt 9*a* and are respectively opposed to the four photosensitive drums 1*a*, 1*b*, 1*c*, 1*d*. These transfer blades 5 are connected to an unrepresented transfer bias source for applying a positive voltage from these blades 5, and the resulting electric field causes the negatively charged toner images on the photosensitive drums 1 to be transferred onto the transfer material in contact therewith, thus forming a color image.

The toner image transferred to the transfer material S is fixed by the application of heat and pressure in passing the fixing means 10 consisting of a rotatively driving and heating roller 10*a* and a driven pressure roller 10*b*.

When the user instructs a full-color image formation, a CPU as the control means executes control in such a manner as to form a full-color image on the transfer material utilizing four photosensitive drums (full-color mode). On the other hand, when the user instructs a monochromatic image formation, the CPU executes control in such a manner as to form a black-and-white image on the transfer material utilizing the photosensitive drum 1*d* only (monochromatic mode). In addition there is provided a multi-color mode for forming a multi-color image utilizing specified two or three photosensitive drums only. The expression "utilizing the photosensitive drum" also means "contacting the photosensitive drum and the transfer material".

<Transfer Material Conveying Configuration>

The transfer material S is conveyed from the feed portion 8 to the image forming area by the conveying means 9.

In the feeding portion 8, plural transfer materials S are contained in the feed cassette 8*a*, close to which provided rotatably is a semicircular pickup roller 8*b* for picking up the transfer material one by one. The transfer material picked up by the intermittent rotation of the above-mentioned pickup roller 8*b* is fed, by paired feed rollers 8*c*, 8*d*, to the transfer conveying belt 9*a*.

The transfer conveying belt 9*a* serving as the transfer material bearing member constituting the conveying means 9 is extended around and supported by a drive roller 9*b* and driven rollers 9*c*, 9*d*, 9*e*, and is positioned opposed to all the photosensitive drums 1*a*, 1*b*, 1*c*, 1*d*. The transfer conveying belt 9*a* is composed of an endless film-shaped member of a thickness of 100 to 150 $\mu$m, normally having a volume resistivity of $10^9$ to $10^{13}$ Ωcm. The volume resistivity is measured with a high resistance meter R8340 of Advantest Inc. under the application of a voltage of 100 V with a measuring probe defined by JIS K6911 and normalized by the thickness of the conveying belt 9*a*.

The above-mentioned transfer conveying belt 9*a* is circulated by the drive roller 9*b*, in order to electrostatically attract the transfer material S on the external periphery opposed to the photosensitive drums 1 and to bring the transfer material into contact with the photosensitive drums 1. Thus the transfer material S is conveyed to the transfer positions by the transfer conveying belt 9*a* and the toner images on the photosensitive drums 1 are transferred.

At the most upstream position of the transfer conveying belt 9*a*, there is provided an attraction roller 9*f* for pinching the transfer material in cooperation with the belt 9*a* and causing the transfer material to be attracted by the transfer conveying belt 9*a*. A bias voltage is applied to the attraction roller 9*f* to form an electric field to the opposed grounded roller 9*b*, thereby generating dielectric polarization between the transfer conveying belt 9*a* and the transfer material to induce an electrostatic attractive force between the belt 9*a* and the transfer material.

<Auxiliary Conveying Configuration>

In the present embodiment, in conveying the transfer material S by the transfer conveying belt 9*a*, auxiliary members are provided in order to prevent peeling of the transfer material S from the transfer conveying belt 9*a*. The auxiliary members are provided on the side, supporting the transfer material, of the transfer conveying belt 9*a*, and also function as deformation means for deforming the transfer conveying belt 9*a* as shown in FIG. 3, as will be explained later.

More specifically, on the surface side of the transfer conveying belt 9*a* there are provided plural auxiliary conveying rollers 14*a* to 14*d* as auxiliary members capable of being rotated by the rotation of the belt 9*a*, and such auxiliary conveying rollers 14*a* to 14*d* are rendered contactable with and separable from the belt 9*a* in the vertical direction by an unrepresented cam mechanism.

In the full-color mode, the auxiliary conveying rollers 14*a* to 14*d* are retracted upwards and are separated from the transfer conveying belt 9*a*. On the other hand, in the monochromatic mode, the cam mechanism is activated to move the auxiliary conveying rollers 14*a* to 14*d* downwards in contact with the transfer conveying belt 9*a*, thereby pressing down the same. Thus the transfer conveying belt 9*a* remains in contact with the black photosensitive drum 1*d* but is separated from other photosensitive drums 1*a*, 1*b*, 1*c*.

Also, as explained in the foregoing, the photosensitive drums 1*b*, 1*c* are so positioned as to protrude more than the photosensitive drums 1*a*, 1*d* toward the transfer conveying belt 9*a*, while the upper tangential line connecting the rollers 9*b*, 9*c* supporting the transfer conveying belt 9*a* (dotted line in FIG. 2) is positioned above the contact points of the photosensitive drums 1*a* to 1*d* with the transfer conveying belt 9*a*, so that the photosensitive drum 1*d* and the transfer material can be maintained in satisfactory contact with each other at the monochromatic recording.

Furthermore, in the monochromatic mode, the transfer material conveying surface of the transfer conveying belt pushed down by the auxiliary conveying rollers 14*a* to 14*d* is so controlled as to assume a convex form downwards (in a direction separating from the photosensitive drums). In such configuration, no protruding portion is formed on the upper side of the transfer conveying belt up to the transfer portion of the photosensitive drum 1*d*, so that the transfer material can be prevented from peeling from the transfer conveying belt or from displacement thereon. In the present embodiment, the auxiliary conveying rollers 14*a* to 14*d* are positioned in a substantially same height in the vertical direction. However, for the reason explained in the foregoing, the two auxiliary conveying rollers 14*b*, 14*c* positioned between the photosensitive drums 1*a* and 1*c* may be positioned lower than other auxiliary conveying rollers 14*a*, 14*d*.

<Image Forming Operation>

In the following there will be explained the image recording operation with the image forming apparatus of the above-described configuration. In case of color image recording, the CPU as the control means retracts the auxiliary conveying rollers 14*a* to 14*d* upwards as shown in FIG. 1. In this state the transfer conveying belt 9*a* is in contact with the four photosensitive drums 1*a*, 1*b*, 1*c*, 1*d* (first mode), and the transfer material fed from the feeding portion 8 is subjected to the successive transfers of the toner images of respective colors while being attracted and conveyed by the transfer conveying belt 9*a*, thereby forming a color image, then subjected to image fixation by the fixing means 10 and discharged to the discharge portion 13.

In the above-described color image recording, since the photosensitive drums 1*a*, 1*b*, 1*c*, 1*d* are in contact with the transfer conveying belt 9*a*, the transfer material is conveyed without peeling from the transfer conveying felt 9*a*, but with receiving the transfers of the toner images.

On the other hand, when there is selected the monochromatic image recording with the black photosensitive drum 1*d* only, the CPU activates the unrepresented cam mechanism to move, as shown in FIG. 3, the auxiliary conveying rollers 14*a* to 14*d* downwards which pushes down the transfer conveying belt 9*a*, whereby the transfer conveying belt 9*a* is separated from the photosensitive drums 1*a*, 1*b*, 1*c*, excluding the black photosensitive drum 1*d* (second mode).

In this state, the black toner image formed by the black photosensitive drum 1*d* is transferred to the transfer material to obtain the monochromatic image. In this operation, the transfer material conveyed by the transfer conveying belt 9*a* is attracted to the transfer conveying belt 9*a* by the charge given by the attraction roller 9*f*, but, because of a lack of the pressing action by the three photosensitive drums 1*a*, 1*b*, 1*c*, the transfer material tends to be peeled off from the transfer conveying belt 9*a* in case the length of the transfer material in the conveying direction thereof is shorter than the distance from the position of the attraction roller 9*f* to the transfer position (contact portion) with the photosensitive drum 1*d*, or under a high humidity environment. In the present embodiment, however the auxiliary conveying rollers 14*a* to 14*d* are in contact with the transfer conveying belt 9*a* and serve to pinch and convey the transfer material in cooperation with the transfer conveying belt 9*a*, whereby the transfer material is not peeled off from the transfer conveying belt 9*a* and is conveyed with a sufficient conveying force to the transfer position of the black photosensitive drum 1*d*.

Naturally, the distance between the auxiliary conveying rollers (in the conveying direction of the transfer material) is selected to be shorter than the length of the transfer material in the conveying direction of the transfer material. Similarly a distance between the attraction roller 9*f* and the roller 14*a*, and a distance between the roller 14*d* and the photosensitive drum 1*d* are selected to be shorter than the length of the transfer material in the conveying direction of the transfer material.

Consequently the image recording can be realized in stable manner without jamming of the transfer material or positional aberration of the transfer material.

The foregoing embodiment has been explained a configuration having four photosensitive drums, but such number is not restrictive and there may be adopted any configuration provided with plural photosensitive drums including at least a black photosensitive drum for forming a black image.

The present invention is also applicable to the multi-color mode, for example, of forming a multi-color image utilizing the photosensitive drums 1*c*, 1*d* only. In such a case the transfer conveying belt is pushed downwards by the auxiliary conveying rollers 14*a* to 14*c*.

Figure 4:
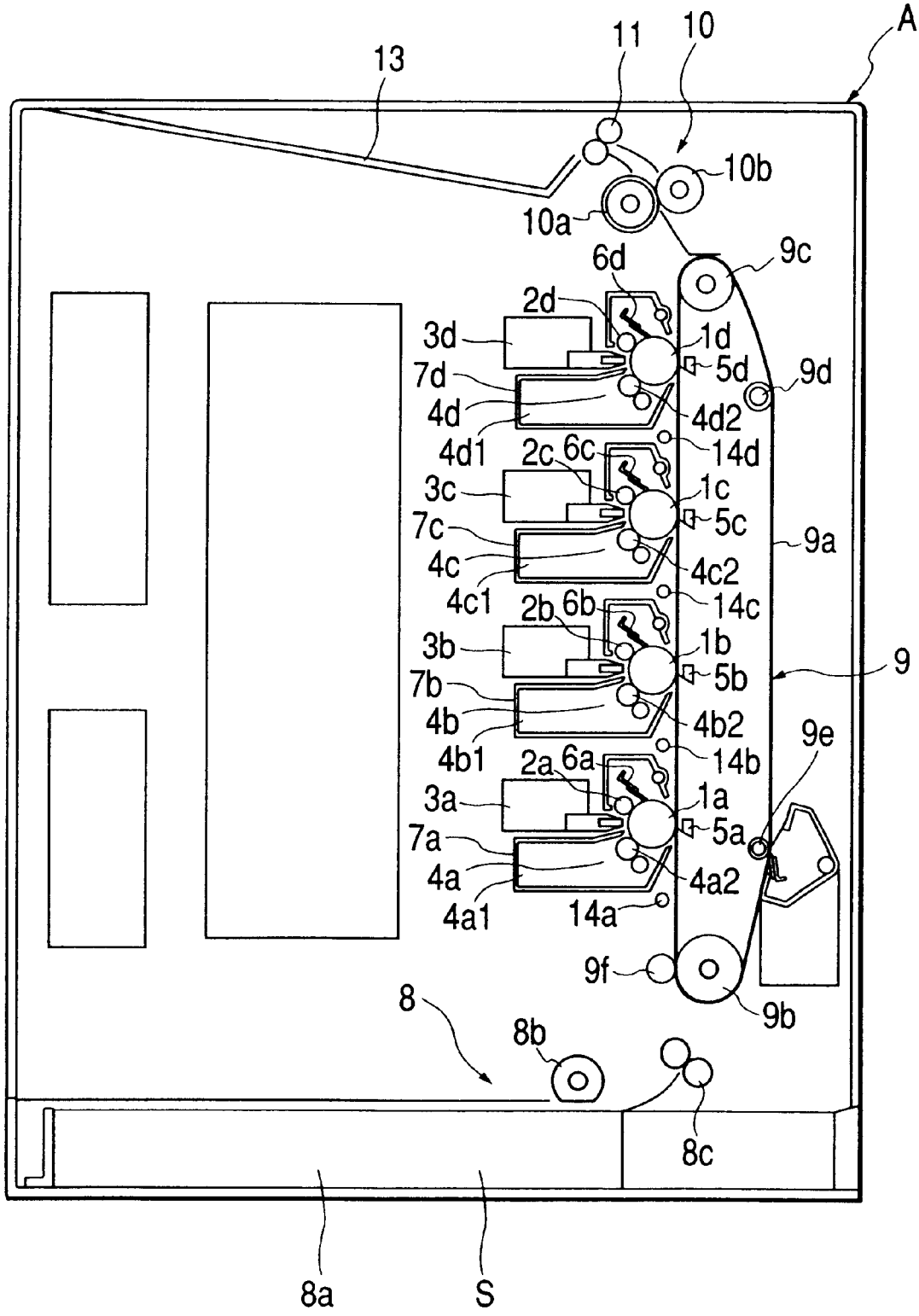
FIGS. 4 and 5 are views showing other embodiments of the present invention.

Also the present invention is applicable and effective in a configuration where the conveying direction of the transfer material by the transfer conveying belt contains a vertical component as shown in FIG. 4, so that the peeling or displacement of the transfer material is easily caused by the weight of the transfer material itself. In the configuration shown in FIG. 4, the conveying direction of the transfer material by the transfer conveying belt is substantially vertically upward.

Figure 5:
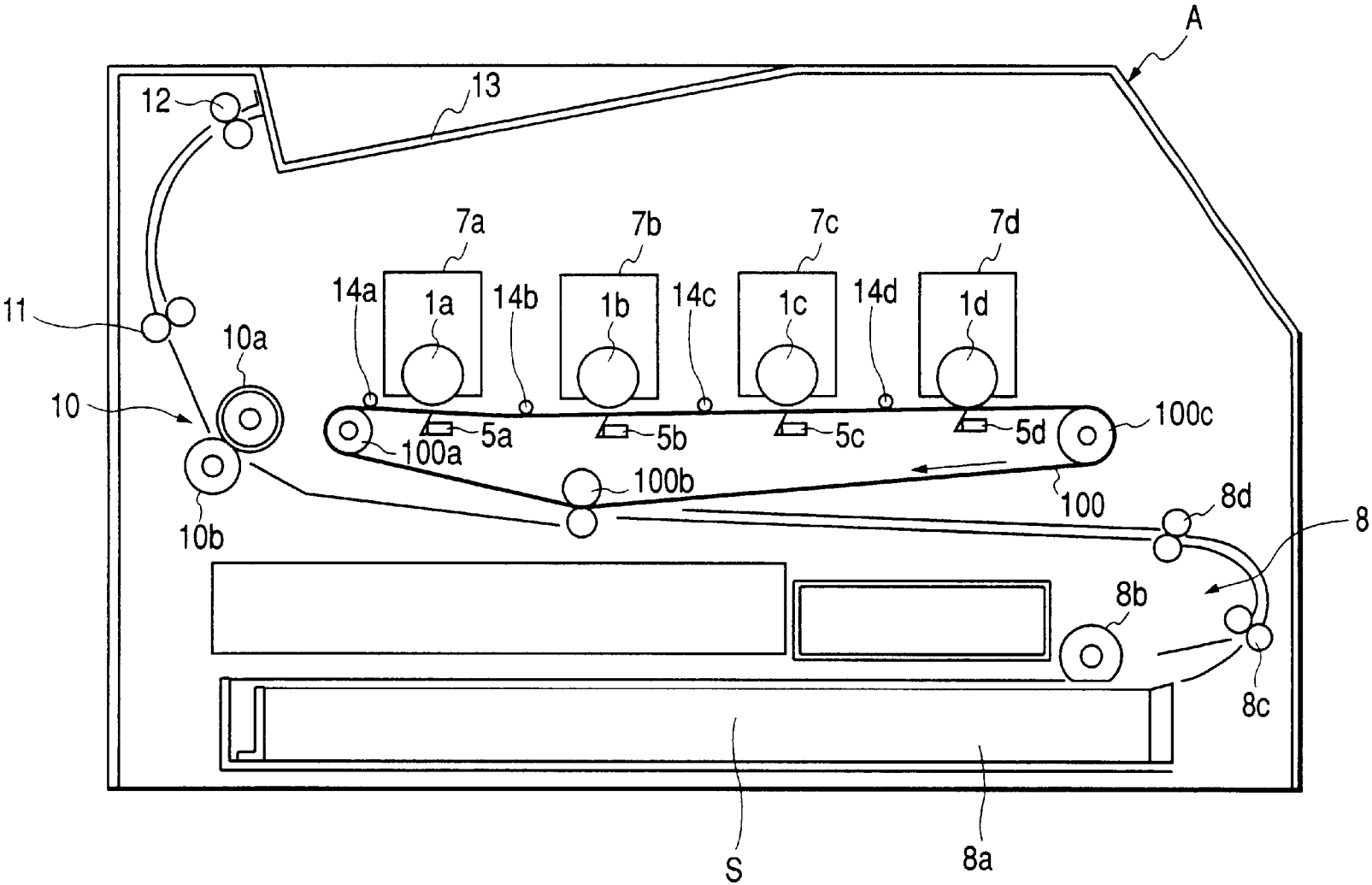
Figure 6:
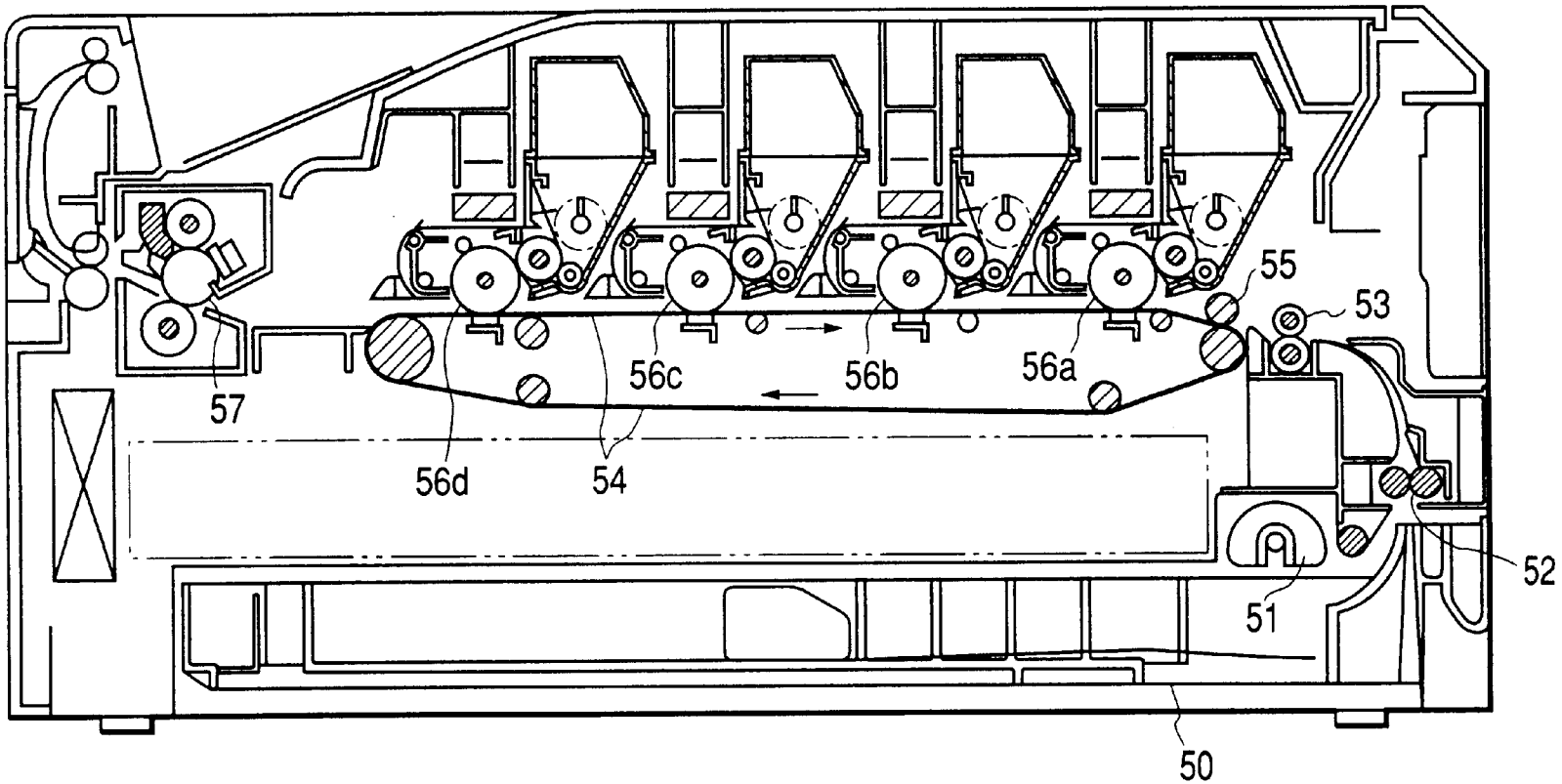
FIG. 6 is a schematic cross-sectional side view of a conventional tandem type image forming apparatus.
Figure 7A:
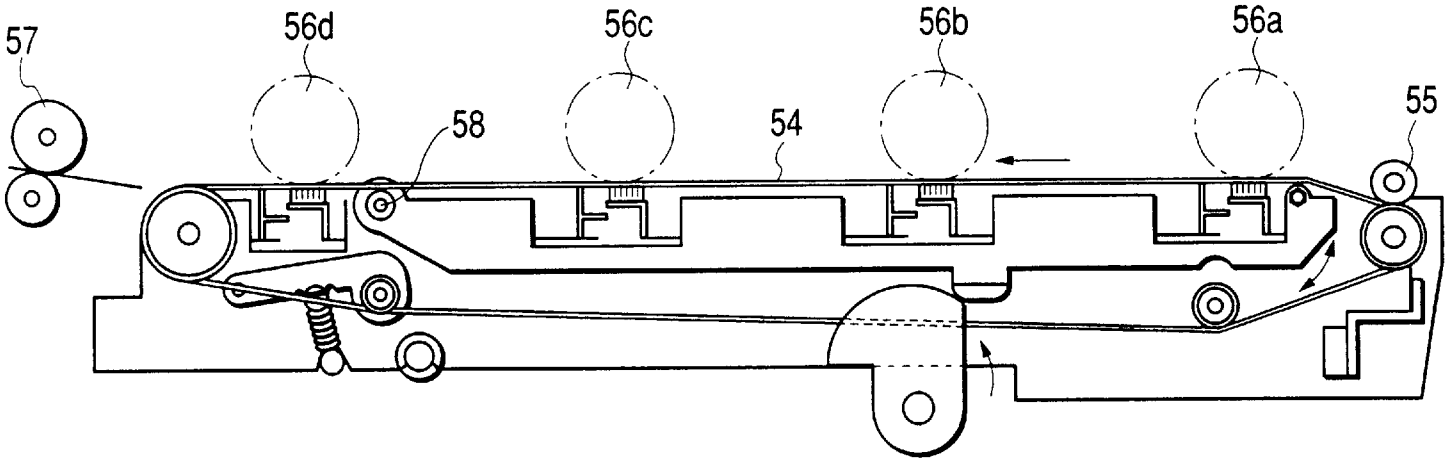
FIGS. 7A and 7B are schematic views showing a relationship between photosensitive drums and a conveyor belt in a color recording and in a monochromatic recording.
Figure 7B:
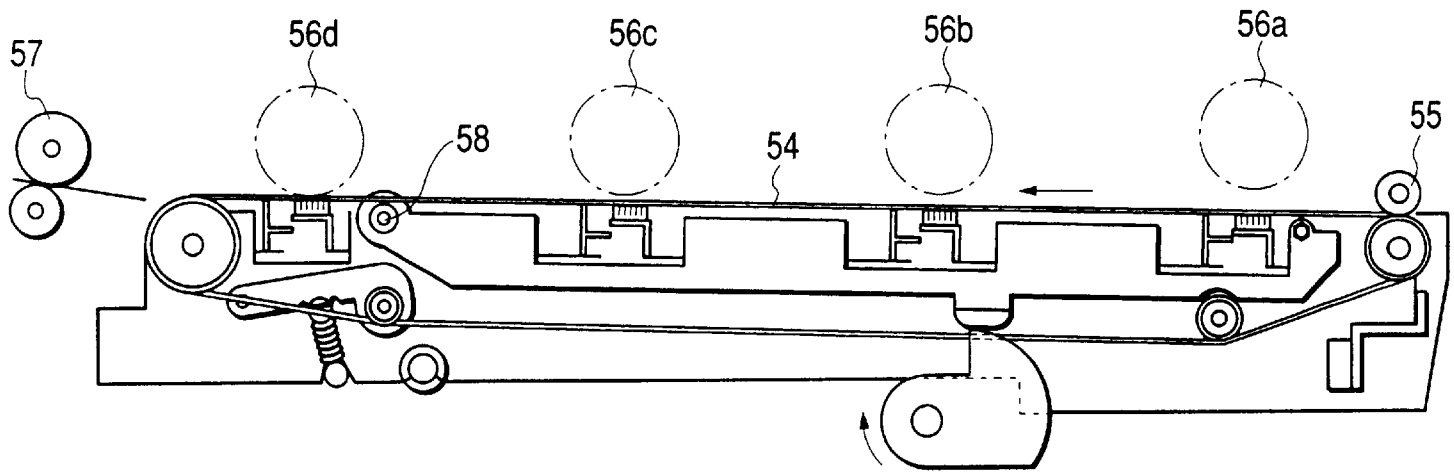

Further, in addition to the image forming apparatus described above, the present invention is likewise applicable to an image forming apparatus employing an intermediate transfer member as shown in FIG. 5.

The image forming process is executed in the following manner. Toner images of respective colors formed on the photosensitive drums 1*a* to 1*d* are primarily transferred in succession and in superposition onto an intermediate transfer belt 100, and then secondarily transferred onto the transfer material (full-color mode). The transfer material is then subjected to the fixation of the full-color toner image thereon by a fixing device 10 and is discharged from the apparatus. In the monochromatic mode, rollers 14*a* to 14*d* are brought into contact with the intermediate transfer belt 100 to push down the belt surface as shown in FIG. 5, whereby the photosensitive drum 1*d* alone remains in contact with the intermediate transfer belt 100. In such a state the black toner image on the photosensitive drum 1*d* is primarily transferred to the intermediate transfer belt 100 and is then secondarily transferred onto the transfer material.

Also in such image forming apparatus, the present invention allows, in the monochromatic mode, to contact the photosensitive drum 1*d* only with the intermediate transfer belt 100, without moving the rollers 100*a*, 100*c* supporting and stretching the intermediate transfer belt 100, whereby the space of the apparatus can be effectively utilized (apparatus being made more compact).

Also in this case, the photosensitive drums 1*b*, 1*c* are offset to the lower side in the drawing, while the uppermost points of the rollers 100*a*, 100*c* are positioned above the lowermost points of the photosensitive drums 1*a*, 1*d*. Consequently, as in the foregoing embodiment, the transfer area (in the moving direction of the intermediate transfer belt) between the photosensitive drum 1*d* and the intermediate transfer belt can be maintained in satisfactory manner, as in the full-color mode, without pushing up the intermediate transfer belt immediately in front of the transfer area.

In FIG. 5, components equivalent in function to those in the foregoing embodiment are represented by same numbers and will not be explained further.

What is claimed is:

1. An image forming apparatus comprising:

a plurality of image bearing members for respectively bearing images of different colors;

a transfer material bearing member for bearing a transfer material;

wherein a mode for transferring, to the transfer material borne by said transfer material bearing member, an image of a predetermined color from a predetermined image bearing member only, selected from said plurality of image bearing members, is selectable; and deformation means for deforming a conveying surface of said transfer material bearing member for the transfer material, said deformation means deforming said conveying surface so that said predetermined image bearing member alone comes into contact with the transfer material borne by said transfer material bearing member when said mode is selected;

wherein said deformation means contacts a side of said transfer material bearing member on which the transfer material is borne to thereby deform the conveying surface.

2. An apparatus according to claim 1, wherein, in said mode, said conveying surface deformed by said deformation means is convex to protrude toward a side opposite to a side on which said image bearing members are provided.

3. An apparatus according to claim 2, wherein said deformation means includes a plurality of rollers rotating in contact with the side of said transfer material bearing member on which the transfer material is borne.

4. An apparatus according to claim 3, wherein at least one of said plurality of rollers is more protruding than the other of said plurality rollers toward said transfer material bearing member.

5. An apparatus according to claim 1, wherein a second mode in which said plurality of image bearing members are contacted with the transfer material borne by said transfer material bearing member to transfer the images of different colors in succession and in superposition from said plurality of image bearing members onto the transfer material borne by said transfer material bearing member at respective transfer positions is selectable, and at least one of the transfer positions is positioned, with respect to other transfer positions, on a side opposite to a side on which said image bearing members are provided.

6. An apparatus according to claim 5, wherein at least one of said plurality of image bearing members is more protruding than a said plurality of image bearing members toward said transfer material bearing member.

7. An apparatus according to claim 5, wherein, when said second mode is selected, said deformation means is separated from said transfer material bearing member.

8. An apparatus according to claim 1, further comprising a first and a second support members for supporting said conveying surface of said transfer material bearing member.

9. An apparatus according to claim 8, wherein said first and said second support members comprise rotatable rollers respectively.

10. An apparatus according to claim 9, wherein a tangential line connecting said first and said second support members on a side on which said plurality of image bearing members are provided, is positioned, on the side on which said plurality of image bearing members are provided, with respect to respective transfer positions in which the images of different colors are transferred in succession and in superposition from said plurality of image bearing members onto the transfer material borne by said transfer material bearing member.

11. An apparatus according to any one of claims 8 to 10, wherein, when said mode is selected, said deformation means deforms said conveying surface without moving said first and second support members.

12. An apparatus according to claim 11, wherein said transfer material bearing member is in a shape of a belt.

13. An apparatus according to claim 11, wherein said predetermined image bearing member bears a black image.

14. An apparatus according to claim 13, wherein said predetermined image bearing member is positioned at a most downstream side in a conveying direction of the transfer material by said transfer material bearing member.

15. An apparatus according to claim 1, wherein a conveying direction of the transfer material by said transfer material bearing member includes a vertical component.

16. An apparatus according to claim 15, wherein a conveying direction of the transfer material by said transfer material bearing member is substantially vertically upward.

17. An apparatus according to claim 1, 15 or.16, further comprising attraction means for electrostatically attracting the transfer material to said transfer material bearing member at an attracting position, wherein a distance from said attracting position to a contact position of said predetermined image bearing member and said transfer material bearing member, in a conveying direction of the transfer material, is longer than a length of the transfer material.

18. An apparatus according to claim 1, further comprising control means for selecting between a mode in which said plurality of image bearing members are contacted with the transfer material borne by said transfer material bearing member to transfer the images of different colors from said plurality of image bearing members onto the transfer material borne by said transfer material bearing member at respective transfer positions in succession and in superposition and a mode in which only said predetermined image bearing member selected among said plurality of image bearing members is in contact with the transfer material borne by said transfer material bearing member to thereby transfer the image of the predetermined color from said predetermined image bearing member onto the transfer material borne by said transfer material bearing member.

19. An apparatus according to claim 1, wherein said transfer material bearing member has a volume resistivity in a range of $10^9$ to $10^{13}$ Ωcm.

20. An image forming apparatus comprising:

a plurality of image bearing members for respectively bearing images of different colors;

an intermediate transfer member;

wherein a mode for transferring, to said intermediate transfer member, an image of a predetermined color from a predetermined image bearing member only selected from said plurality of image bearing members, is selectable; and deformation means for deforming a transfer surface of said intermediate transfer member onto which the image is transferred, said deformation means deforming, the transfer surface so that said predetermined image bearing member alone comes into contact with said intermediate transfer member when said mode is selected;

wherein said deformation means contacts a side of said intermediate transfer member onto which the image is transferred to thereby deform the transfer surface.

21. An apparatus according to claim 20, wherein, in said mode, said transfer surface deformed by said deformation means is convex to protrude toward a side opposite to a side on which said image bearing members are provided.

22. An apparatus according to claim 21, wherein said deformation means includes a plurality of rollers rotating in contact with the side of said intermediate transfer member onto which the image is transferred.

23. An apparatus according to claim 22, wherein at least one of said plurality of rollers is more protruding than other of said plural rollers toward said intermediate transfer member.

24. An apparatus according to claim 20, wherein a second mode in which said plurality of image bearing members are contacted with said intermediate transfer member to transfer the images of different colors in succession and in superposition from said plurality of image bearing members onto said intermediate transfer member at respective transfer positions is selectable, and at least one of said transfer positions is positioned, with respect to other transfer positions, on a side opposite to a side on which said image bearing members are provided.

25. An apparatus according to claim 24, wherein at least one of said plurality of image bearing members is more protruding than the other of said plurality of image bearing members toward said intermediate transfer member.

26. An apparatus according to claim 24, wherein, when said second mode is selected, said deformation means is separated from said intermediate transfer member.

27. An apparatus according to claim 20, further comprising a first and a second support members for supporting said transfer surface of said intermediate transfer member.

28. An apparatus according to claim 27, wherein said first and said second support members comprise rotatable rollers respectively.

29. An apparatus according to claim 28, wherein a tangential line connecting said first and said second support members on a side on which said plurality of image bearing members are provided is positioned, on the side on which said plurality of image bearing members are provided, with respect to respective transfer positions in which the images of different colors are transferred in succession and in superposition from said plurality of image bearing members onto said intermediate transfer member.

30. An apparatus according to any one of claims 27 to 29, wherein, when said mode is selected, said deformation means deforms said transfer surface without moving said support members.

31. An apparatus according to claim 30, wherein said intermediate transfer member is in a shape of a belt.

32. An apparatus according to claim 20, further comprising control means for selecting between a mode in which said plurality of image bearing members are contacted with said intermediate transfer member to transfer the images of different colors from said plurality of image bearing members onto said intermediate transfer member at respective transfer positions in succession and in superposition and a mode in which only said predetermined image bearing member selected among said plural image bearing members is in contact with said intermediate transfer member to thereby transfer the image of the predetermined color from said predetermined image bearing member only onto said intermediate transfer member.

33. An image forming apparatus comprising:

a plurality of image bearing members for respectively bearing image of different color;

a transfer material bearing member for bearing a transfer material, wherein a mode for transferring, to the transfer material borne by said transfer material bearing member, an image of a predetermined color from a predetermined image bearing member only selected from said plural image bearing members, is selectable; and an abutment member for abutting against said transfer material bearing member so that said predetermined image bearing member alone comes into contact with the transfer material borne by said transfer material bearing member when said mode is selected, wherein said abutment member contacts a side of said transfer material bearing member on which the transfer material is borne.

34. An apparatus according to claim 33, wherein the transfer material passes between said abutment member and said transfer material bearing member.

35. An apparatus according to claim 33, wherein said abutment member is a roller.

36. An image forming apparatus comprising:

a plurality of image bearing members for respectively bearing image of different color;

an intermediate transfer member, wherein a mode for transferring, to said intermediate transfer member, an image of a predetermined color from a predetermined image bearing member only selected from said plurality of image bearing members, is selectable; and an abutment member for abutting against said intermediate transfer member so that said predetermined image bearing member alone comes into contact with said intermediate transfer member when said mode is selected, wherein said abutment member contacts a side of said intermediate transfer member onto which the image is transferred.

37. An apparatus according to claim 36, wherein said abutment member is a roller.

* * * * *

UNITED STATES PATENT AND TRADEMARK OFFICE

CERTIFICATE OF CORRECTION

PATENT NO. : 6,356,732 B1
DATED : March 12, 2002
INVENTOR(S) : Kenji Watanabe et al.

It is certified that error appears in the above-identified patent and that said Letters Patent is hereby corrected as shown below:

Title page,
Item [57] ABSTRACT, line 11, "for" should be deleted.

Column 2,
Line 5, "is" should read -- is in --; and
Line 65, "following" should read -- following, --.

Column 3,
Line 42, "following" should read -- following, --.

Column 5,
Line 62, "following" should read -- following, --.

Column 6,
Line 45, "Similarly" should read -- Similary, --;
Line 51, "Consequently" should read -- Consequently, --;
Line 54, "The" should read -- In the --; and
Line 64, "Also" should read -- Also, --.

Column 8,
Line 65, "or.16," should read -- or 16, --.

Signed and Sealed this

Twenty-first Day of May, 2002

*Attest:*

*Attesting Officer*

JAMES E. ROGAN
*Director of the United States Patent and Trademark Office*